US005782598A

United States Patent [19]

Salzberger

[11] Patent Number: 5,782,598

[45] Date of Patent: Jul. 21, 1998

[54] PERSONALIZED PAPER BOOK COVER

[76] Inventor: Marc Salzberger, 84-42 Fleet Ct. #12A, Middle Village, N.Y. 11379

[21] Appl. No.: 529,624

[22] Filed: Sep. 15, 1995

[51] Int. Cl.[6] ..... B42C 19/00

[52] U.S. Cl. ..... 412/4; 283/67; 283/70; 283/63.1

[58] Field of Search ..... 281/19.1, 15.1, 281/51; 283/56, 117, 67

[56] References Cited

U.S. PATENT DOCUMENTS

| | | | |
|---|---|---|---|
| 3,252,462 | 5/1966 | Quarton et al. | 281/19.1 X |
| 4,527,814 | 7/1985 | Carter et al. | 281/19.1 X |
| 5,009,361 | 4/1991 | Chariton et al. | 281/19.1 X |
| 5,114,291 | 5/1992 | Hefty | 283/67 X |
| 5,213,461 | 5/1993 | Kalishen | 283/67 X |
| 5,397,156 | 3/1995 | Schach et al. | 283/67 |

*Primary Examiner*—Willmon Fridie, Jr.

[57] ABSTRACT

A while you wait process which takes a book buyer's picture and inserts it, with a caption, onto the back of a purchased book's paper-cover. The customer looks into a video camera and/or supplies a photograph, which is scanned into a computer. The book's cover is also entered into the computer and is there edited to incorporate the picture and the text of a caption. The customized cover is then achieved on the store's printer. Alternatively, a publisher provides paper book-covers containing spaces free of text and graphics. The customer's captioned pictures are then printed onto these voids.

14 Claims, 1 Drawing Sheet

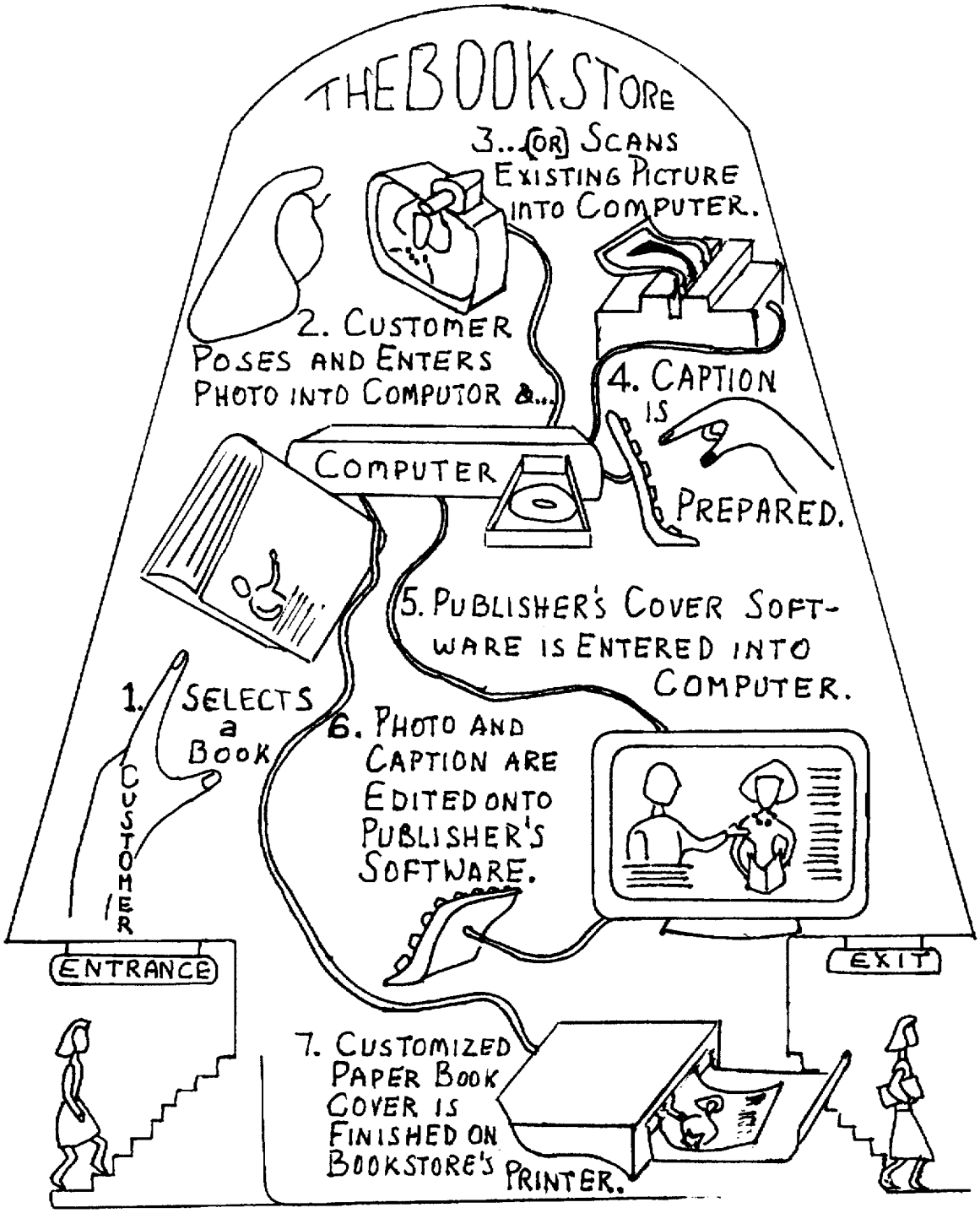
THE BOOKSTORE
3.. (OR) SCANS EXISTING PICTURE INTO COMPUTER..
2. CUSTOMER POSES AND ENTERS PHOTO INTO COMPUTOR &...
4. CAPTION IS PREPARED.
COMPUTER
5. PUBLISHER'S COVER SOFTWARE IS ENTERED INTO COMPUTER.
1. SELECTS a BOOK
CUSTOMER
6. PHOTO AND CAPTION ARE EDITED ONTO PUBLISHER'S SOFTWARE.
ENTRANCE
EXIT
7. CUSTOMIZED PAPER BOOK COVER IS FINISHED ON BOOKSTORE'S PRINTER.

PERSONALIZED PAPER BOOK COVER

BACKGROUND-FIELD OF INVENTION

This invention relates to photo customizing published printed matter. More particularly it involves taking a customer's picture in a book store and printing it onto a book's paper cover.

BACKGROUND-DESCRIPTION OF PRIOR ART

In the beginning paper book covers were the publisher's versions of the home made expedients of fastidious readers. But beginning in the second decade of the 20th century these covers ceased to be essentially dust jackets and became graphic and informative projections of their texts and authors: a way for a book to reach out to its public. Attempts in reverse, to enable the public to reach into a book, have been less graphic. They have amounted to inviting readers, generally children, to strew names and story lines and text illustrations onto the pages between the covers. That is what U.S. Pat. No. 5,141,252 to Michlin (1992) discloses. U.S. Pat. No. 5,213,461 to Kalisher (1993) is a swifter method of the same process. U.S. Pat. No. 5,397,156 to Schach (1995) uses the mail. None of these disclosures and none which I am aware of have sought to put the public overtly, elbow to elbow with an author, onto a book's cover.

OBJECTS AND ADVANTAGES

Though a book is mass produced for a mass public it in effect amounts to one lone individual whispering from within himself, through the medium of print, into the mind of another lone individual. Publishers accordingly have sought to catch the prospective reader's interest by projecting onto the paper cover personal details, which sometimes include a photograph, of the often famous individual doing the whispering inside.

The present invention closes the circuit, completes the logic. The human being listening this side of the page is named on the books cover, pictured and acknowledged as a partner in the enterprise. By sharing the same wrap around the text with the reader, the author not merely boasts of having found this reader but awakes in him or her a special personal interest in the (ir) book.

Furthermore, the invention serves the book buyer who means to make a present of a book. By him-or-herself appearing on the cover, possibly alongside a photograph of the person for whom the book is intended, a lasting record of the gift is notched, as well as a sustaining emotional imprint.

And finally, returning to the original purpose of paper covers, this invention prolongs the life of books. Most books, once read, become as uninteresting and useless as yesterday's newspaper. Unless yesterdays newspaper happens to include a mention of oneself. Then it is cosseted and preserved and treated like a family heirloom. Just so with books in personalized dust covers.

Still further objects and advantages will become apparent from a consideration of the ensuing description.

DESCRIPTION OF OPERATION

The invention retrofits a) the conventional paper cover of a book with b) the book buyers captioned picture of him or herself, or of others.

The procedure, which takes place at the retail level, requires only minutes; and much of the work can be left to the customer.

The customer, having chosen a book, looks into a video or digital camera and then into a video monitor to select a particular pose. A photograph in a customer's wallet may also be introduced by way of an optical scanner; and a younger book buyer may want to draw a picture with a lettered message on an electronic writing pad. A caption is typed out on a keyboard. All this input is absorbed by the store's computer, as is entered data representing the purchased book's paper cover. It can be scanned into the computer, but in the preferred embodiment a book's envelope is available to the store as software. The captioned picture and the paper cover are then examined on the video monitor and their various aspects cropped, reduced, eliminated, enlarged, i.e., fitted, one into the other. Where the cover is available as software, designed with none variable and mutable elements, the editing task is simplified; and montage options can make the result inimitable.

A typical embodiment will divide the surface to be customized into two or three parts: for the captioned photo of the author, of the customer, or of the book's buyer and of whomever the book is intended for.

Alternatively, the back of the envelope can contain one large photograph wherein the author sits in a chair near a picture frame into which the prospective reader's picture has been edited. And the book's buyer can appear to be leaning into the room through an open window, reaching towards the book in the author's outstretched hand.

Or the book buyer might simply be photographed in the store holding a copy of the book, or looking at a picture of the author, in the manner of "Aristotle Contemplating the Bust of Homer."

Once the material has been united inside the computer it must be printed out on the store's printer, and this is accomplished, principally in one of two ways.

Where the envelope is made available to the store in a publisher's incomplete version, with certain surface areas deliberately left empty. This can apply to both the backs of paperback books and to the paper covers of hard backed volumes. In the former case the entire paperback is inserted into the retailer's printer, the unfinished surface exposed to the writing heads. In the latter, the publisher's unfinished paper cover is removed from the book and mounted in the printer, and is there completed.

The other route applies to those hard covered books for which the publisher has not made incomplete paper covers available, or where it is deemed undesirable that a cover be the product of two separate printing operations. In such cases, and only with the publisher's authorization, a paper of the size and shape of the original cover is mounted in the retailer's printer and the entire modified cover is then printed out.

SUMMARY, RAMIFICATIONS, AND SCOPE

Accordingly, this process takes the book cover on which the book publisher has placed the author, and has the book seller place the reader on it as well.

The result gives a book a new kind of dress, a garment with various functions and for varying seasons.

It is a new and superior way for the author, in affect, to autograph his book for an individual reader.

It serves the gift giver as a sleeve wherewith to safely hand over a book, sure in the knowledge that the gesture will not slip from the mind.

It allows a book to become a treasured artifact, as when a 9 year old receives a volume with herself and her mother on the cover, which two decades later she entrusts to her 9 year old.

Personalizing any book immediately creates a bias in its favor and turns it into an urgent read.

And in later years, even though the text may have faded from memory, a book will continue to be cherished if its paper cover serves it as an unsinkable buoy and testimonial of the time when reader and writer got together.

Ultimately it effects a role reversal. Beginning modestly, as body guard and side-kick to the book, this cover ends up as memorabilia and the main attraction, served by the book as stuffing and an easel.

As to the ramifications and scope of my invention: it suggests a division of labor wherein the publisher maintains a software library which the book seller (and the greeting cards stationer too) will access electronically and use as templates for text individually customized and locally printed.

I claim:

1. A process for incorporating a book buyer's picture into the publisher's paper cover, of the volume said book buyer buys, in steps which involve:

(a) interfacing a computer having memory and a programed editing capacity with a variety of peripheral devices including a keyboard, a video monitor, electro optical image capturing apparatus and a printer (b) generating, by means of said electro optical image capturing apparatus, data representing said customer's picture (c) entering said data into said computer (d) adjusting and positioning said data within programed parameters, by means of said editing capacity (e) inserting and mounting in said printer a paper surface identical in size and shape to said volume's paper cover (f) printing onto said paper surface the edited data.

2. The process of claim 1 wherein a caption of text is entered into said computer by means of said keyboard peripheral.

3. The process of claim 2 wherein said publisher's paper cover has a surface which includes a substantial area of void space, and is said paper surface that is mounted in said printer.

4. The process of claim 2 wherein said publisher's paper cover is entered into said computer as data and is there modified by means of said editing capacity to include said book buyer's picture and caption data.

5. The process of claim 2 wherein said publisher's paper cover is entered into said computer in the form of programed software composed of a combination of non variable data and such data as will accept editorial changes.

6. The process of claim 1 wherein said peripheral devices include a video camera, an optical scanner and an electronic writing pad with stylus.

7. A process wherein a retailer uses the customer's picture to customize the printed paper envelope containing published matter, in steps comprising:

(a) interfacing a computer having memory and a programed editing capacity, with peripheral devices including a keyboard, a monitor, a printer and electro optical apparatus selected from the group consisting of scanners and digital and video cameras (b) generating, by means of said electro optical apparatus, data representing a picture of said customer (c) entering said data into said computer (d) adjusting and positioning said data within programed parameters, by means of said editing capacity (e) inserting and mounting in said printer a paper surface identical in size and shape to said printed paper envelope (f) printing the edited data onto said paper surface.

8. The process of claim 7 wherein a caption of personal text is entered into said computer by means of said keyboard peripheral.

9. The process of claim 8 wherein said printed paper envelope is the cover of a paperback book which has an outer surface whereon is included a substantial area of void space, and is furthermore said paper surface which is mounted in said printer, same having the capacity to adjust to bulky surfaces.

10. The process of claim 7 wherein (a) said printed paper envelope contains one outer surface that is to a large degree empty and which is the paper surface which is subsequently mounted in said retailer's printer (b) said retailer enters into said computer, programed software related to said printed paper envelope, and composed in part of non variable data and data which can be editorially manipulated, and (c) said customer's picture and caption data is edited into the matrix of said non variable and variable data.

11. The process of claim 7 wherein said peripherals include an electronic writing pad with stylus.

12. A process for retrofitting on the retail level, an item of mass produced published material with an individual customer's picture, in steps comprising:

(a) interfacing a computer having memory and a programed editing capacity with such peripherals as a keyboard, and electro optical imaging apparatus selected from the group consisting of optical scanners and digital and video cameras, and a printer (b) generating, by means of said electro optical imaging apparatus, data representing said customer's picture (c) entering said data into said computer (d) adjusting and positioning said data within programed parameters, by means of said editing capacity (e) inserting and mounting in said printer a paper surface identical in size and shape to said published material (f) printing onto said paper surface the edited data.

13. The process of claim 12 wherein a caption of personal text is entered into said computer by means of said keyboard peripheral.

14. The process of claim 12 wherein is entered into said computer, for inclusion in the retrofitting, a pattern of data wherewith said retail establishment identifies.

* * * * *